US012072104B1

(12) United States Patent
Strzepek

(10) Patent No.: US 12,072,104 B1
(45) Date of Patent: Aug. 27, 2024

(54) FUEL DELIVERY APPARATUS FOR A GAS TURBINE ENGINE

(71) Applicant: Pratt & Whitney Canada Corp., Longueuil (CA)

(72) Inventor: Jakub Strzepek, Rzeszów (PL)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/371,887

(22) Filed: Sep. 22, 2023

(51) Int. Cl.
*F23R 3/28* (2006.01)
*F23D 14/58* (2006.01)
*F23D 14/62* (2006.01)

(52) U.S. Cl.
CPC ..... *F23R 3/286* (2013.01); *F23D 14/58* (2013.01); *F23D 14/62* (2013.01)

(58) Field of Classification Search
CPC ..... F23D 11/383; F23D 14/24; F23D 14/48; F23D 14/58; F23D 14/62; F23D 2206/10; F23D 2900/14021; F23R 3/12; F23R 3/286
See application file for complete search history.

(56) References Cited

U.S. PATENT DOCUMENTS

| | | | | |
|---|---|---|---|---|
| 8,348,180 | B2 | 1/2013 | Mao | |
| 9,752,774 | B2 | 9/2017 | Wang | |
| 10,228,137 | B2 | 3/2019 | Kopp-Vaughan | |
| 11,421,883 | B2 | 8/2022 | Binek | |
| 2020/0139390 | A1* | 5/2020 | Thomson | F23R 3/14 |

FOREIGN PATENT DOCUMENTS

| | | | |
|---|---|---|---|
| JP | 06181997 | B2 | 1/2015 |
| WO | 2014113105 | A2 | 7/2014 |

* cited by examiner

*Primary Examiner* — Scott J Walthour
(74) *Attorney, Agent, or Firm* — Getz Balich LLC

(57) ABSTRACT

A fuel delivery apparatus is provided for a gas turbine engine. This fuel delivery apparatus includes a fuel injector. The fuel injector includes a plurality of fuel passages, a guide passage, a plurality of air passages, a mixing cavity and a fuel injector outlet. The fuel passages extend along an axis to the guide passage. The fuel passages converge radially inwards towards the axis as the fuel passages spiral about the axis towards the guide passage. The guide passage turns radially outwards away from the axis as the guide passage extends from the fuel passages to the mixing cavity. The air passages converge radially inwards towards the axis as the air passages extend axially to the mixing cavity. The mixing cavity fluidly couples the guide passage and the air passages to the fuel injector outlet.

14 Claims, 5 Drawing Sheets

FUEL DELIVERY APPARATUS FOR A GAS TURBINE ENGINE

TECHNICAL FIELD

This disclosure relates generally to a gas turbine engine and, more particularly, to fuel delivery for the gas turbine engine.

BACKGROUND INFORMATION

A gas turbine engine typically includes multiple fuel injectors for delivering fuel for combustion within a combustion chamber. Various types and configurations of fuel injectors are known in the art. While these known fuel injectors have various benefits, there is still room in the art form improvement.

SUMMARY

According to an aspect of the present disclosure, a fuel delivery apparatus is provided for a gas turbine engine. This fuel delivery apparatus includes a fuel injector. The fuel injector includes a plurality of fuel passages, a guide passage, a plurality of air passages, a mixing cavity and a fuel injector outlet. The fuel passages extend along an axis to the guide passage. The fuel passages converge radially inwards towards the axis as the fuel passages spiral about the axis towards the guide passage. The guide passage turns radially outwards away from the axis as the guide passage extends from the fuel passages to the mixing cavity. The air passages converge radially inwards towards the axis as the air passages extend axially to the mixing cavity. The mixing cavity fluidly couples the guide passage and the air passages to the fuel injector outlet.

According to another aspect of the present disclosure, another fuel delivery apparatus is provided for a gas turbine engine. This fuel delivery apparatus includes a fuel injector. The fuel injector includes a plurality of fuel passages, a guide passage, a plurality of air passages, a mixing cavity, a fuel injector outlet, an inner structure and an outer structure circumscribing the inner structure. The fuel passages are radially between the inner structure and the outer structure. Each of the fuel passages projects radially into the inner structure. Each of the fuel passages spirals about the inner structure to the guide passage. The guide passage is radially and axially between the inner structure and the outer structure. The guide passage fluidly couples the fuel passages to the mixing cavity. The air passages project axially through the outer structure to the mixing cavity. The mixing cavity fluidly couples the guide passage and the air passages to the fuel injector outlet. The mixing cavity extends radially within the outer structure. The mixing cavity is axially between the outer structure and the inner structure.

According to still another aspect of the present disclosure, another fuel delivery apparatus is provided for a gas turbine engine. This fuel delivery apparatus includes a fuel nozzle insert, a flow guide, an air swirler body, a plurality of fuel passages, an annular mixing cavity, an annular guide passage and a plurality of air passages. The flow guide is connected to and projects axially along an axis out from an end of the fluid nozzle insert. The air swirler body circumscribes the fuel nozzle insert and the flow guide. The fuel passages are formed by and radially between the fuel nozzle insert and the air swirler body. The fuel passages radially converge and spiral about the fuel nozzle insert towards the flow guide. The annular mixing cavity is formed by and axially between the flow guide and the air swirler body. The annular guide passage extends radially outward from the fuel passages to the annular mixing cavity. The air passages project axially through the air swirler body to the mixing cavity.

The air passages may be a plurality of inner air passages. The air swirler body may also include a plurality of outer air passages arranged in an array radially outboard of the inner air passages. Each of the outer air passages may extend through the air swirler body.

The fuel passages may converge radially inwards as the fuel passages spiral about the inner structure to the guide passage.

The air passages may be a plurality of inner air passages. The fuel injector may also include a plurality of outer air passages arranged in an array radially outboard of the inner air passages. Each of the outer air passages may extend through the outer structure.

The fuel delivery apparatus may also include a hydrogen fuel source configured to deliver hydrogen fuel to the fuel passages.

The guide passage may be an annular guide passage. In addition or alternatively, the mixing cavity may be an annular mixing cavity. In addition or alternatively, the fuel injector outlet may be an annular fuel injector outlet.

The fuel injector may also include an inner structure and an outer structure circumscribing the inner structure. Each of the fuel passages may be disposed radially between and formed by the inner structure and the outer structure.

The guide passage may be disposed radially and axially between and formed by the inner structure and the outer structure.

The mixing cavity may be disposed axially between and formed by the inner structure and the outer structure.

The inner structure may be configured as or otherwise include an insert disposed in an inner bore of the outer structure. Each of the fuel passages may be configured as or otherwise include a channel projecting into the insert.

The inner structure may also include a flow guide attached to and projecting axially out from an end of the insert. The flow guide may include an outer surface forming an inner peripheral boundary of the guide passage. The outer surface may have a curved sectional geometry which curves radially outward away from the axis as the outer surface extends axially away from the insert.

The outer surface may radially overlap the outer structure and may also form a side peripheral boundary of the mixing cavity.

The fuel injector outlet may extend between and may be formed by an outer peripheral edge of the flow guide and the outer structure.

The flow guide may be attached to the insert by a threaded connection.

Each of the air passages may extend through a flange of the outer structure.

The air passages may be a plurality of inner air passages. The fuel injector may also include a plurality of outer air passages arranged radially outboard of the inner air passages. Each of the outer air passages may extend through the flange of the outer structure.

The air passages may also extend circumferentially about the axis as the air passages extend axially to the mixing cavity.

The fuel delivery apparatus may also include a fuel source configured to deliver gaseous fuel to the fuel injector.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
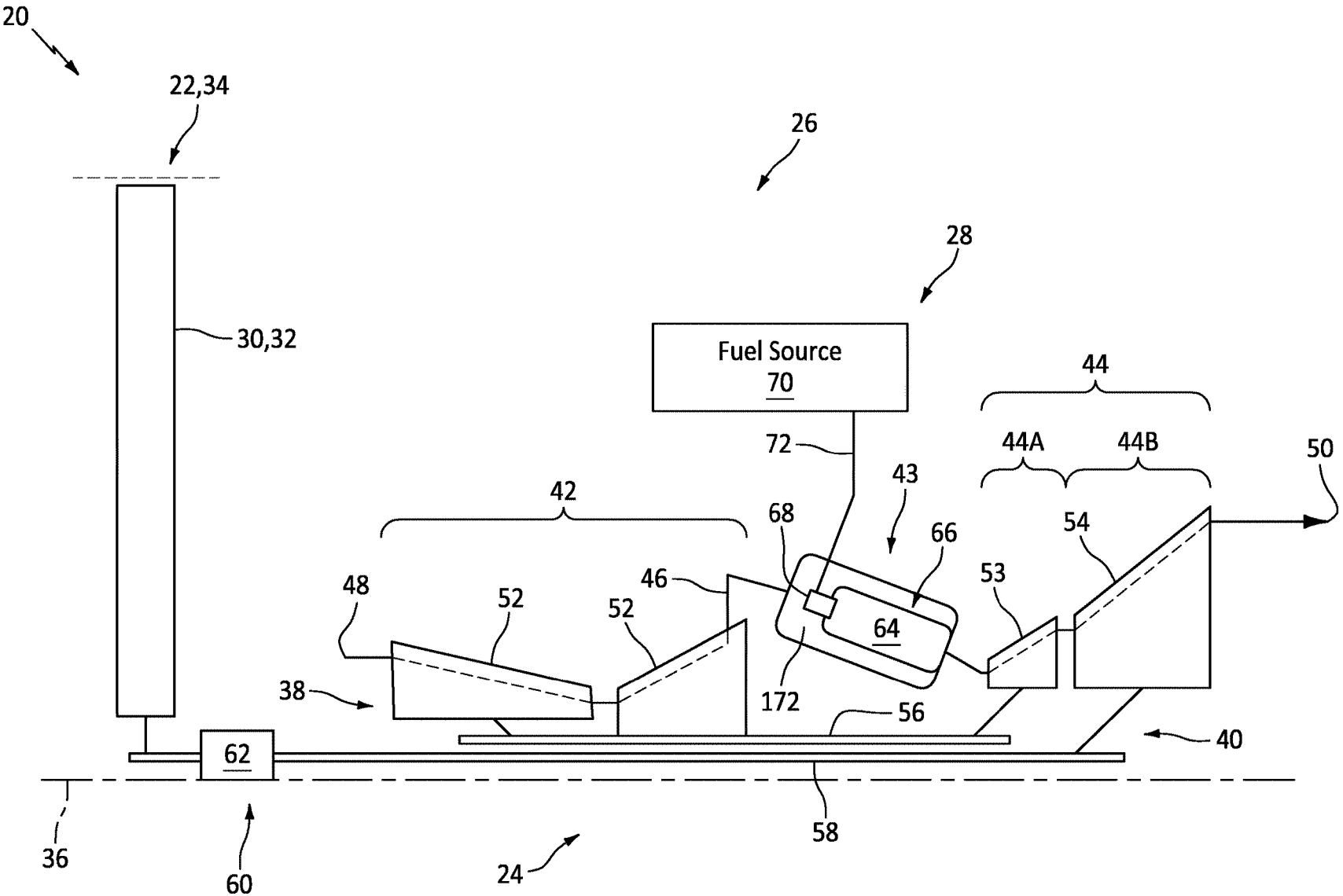
FIG. 1 is a partial side schematic illustration of an aircraft system with a gas turbine engine.

FIG. 1 illustrates a system 20 for an aircraft. The aircraft may be an airplane, a helicopter, a drone (e.g., an unmanned aerial vehicle (UAV)) or any other manned or unmanned aerial vehicle or system. The aircraft system 20 may be configured as, or otherwise included as part of, a propulsion system for the aircraft. The aircraft system 20 may also or alternatively be configured as, or otherwise included as part of, an electrical power system for the aircraft. The aircraft system 20 of FIG. 1 includes a mechanical load 22 and a core 24 of a gas turbine engine 26. The aircraft system 20 also include a fuel delivery system 28.

The mechanical load 22 may be configured as or otherwise include a rotor 30 mechanically driven and/or otherwise powered by the engine core 24. This driven rotor 30 may be a bladed propulsor rotor 32 (e.g., an air mover) where the aircraft system 20 is (or is part of) the aircraft propulsion system. The propulsor rotor 32 includes a plurality of rotor blades arranged circumferentially around and connected to at least (or only) one rotor base (e.g., a disk, a hub, etc.). The propulsor rotor 32 may be an open (e.g., un-ducted) propulsor rotor or a ducted propulsor rotor. Examples of the open propulsor rotor include a propeller rotor for a turboprop propulsion system, a rotorcraft rotor (e.g., a main helicopter rotor) for a turboshaft propulsion system, a propfan rotor for a propfan propulsion system, and a pusher fan rotor for a pusher fan propulsion system. An example of the ducted propulsor rotor is a fan rotor for a turbofan propulsion system. The present disclosure, of course, is not limited to the foregoing exemplary propulsor rotor arrangements. Moreover, the driven rotor 30 may alternatively be a generator rotor of an electric power generator where the aircraft system 20 is (or is part of) the aircraft power system; e.g., an auxiliary power unit (APU) for the aircraft. However, for ease of description, the mechanical load 22 may be generally described below as a propulsor section 34 of the gas turbine engine 26 and the driven rotor 30 may be generally described as the propulsor rotor 32 within the propulsor section 34.

The engine core 24 extends axially along an axial centerline 36 between an upstream, forward end of the engine core 24 and a downstream, aft end of the engine core 24. This axial centerline 36 may be a centerline axis of the gas turbine engine 26 and/or its engine core 24. The axial centerline 36 may also or alternatively be a rotational axis of one or more rotating assemblies (e.g., 38 and 40) of the gas turbine engine 26 and its engine core 24. The engine core 24 includes a compressor section 42, a combustor section 43, a turbine section 44 and a core flowpath 46. The turbine section 44 of FIG. 1 includes a high pressure turbine (HPT) section 44A and a low pressure turbine (LPT) section 44B; e.g., a power turbine (PT) section. The core flowpath 46 extends sequentially through the compressor section 42, the combustor section 43, the HPT section 44A and the LPT section 44B from an airflow inlet 48 into the core flowpath 46 to a combustion products exhaust 50 from the core flowpath 46. The core inlet 48 may be disposed at (e.g., on, adjacent or proximate) the forward end of the engine core 24, and the core exhaust 50 may be disposed at the aft end of the engine core 24.

The compressor section 42 includes one or more bladed compressor rotors 52. The HPT section 44A includes at least one bladed high pressure turbine (HPT) rotor 53. The LPT section 44B includes at least one bladed low pressure turbine (LPT) rotor 54. Each of these engine rotors 52-54 includes a plurality of rotor blades (e.g., airfoils, vanes, etc.) arranged circumferentially around and connected to one or more rotor bases (e.g., disks, hubs, etc.). Each of the engine rotors 52-54 may be configured with one or more stages; e.g., one or more arrays of the rotor blades arranged along the core flowpath 46.

The compressor rotors 52 are coupled to and rotatable with the HPT rotor 53. The compressor rotors 52 of FIG. 1, for example, are connected to the HPT rotor 53 by a high speed shaft 56. At least (or only) the compressor rotors 52, the HPT rotor 53 and the high speed shaft 56 collectively form the high speed rotating assembly 38; e.g., a high speed spool. The LPT rotor 54 is connected to a low speed shaft 58. At least (or only) the LPT rotor 54 and the low speed shaft 58 collectively form the low speed rotating assembly 40. This low speed rotating assembly 40 is further coupled to the driven rotor 30 (e.g., the propulsor rotor 32) through a drivetrain 60. The drivetrain 60 may be configured as a geared drivetrain, where a geartrain 62 (e.g., a transmission, a speed change device, an epicyclic geartrain, etc.) is disposed between and operatively couples the driven rotor 30 to the low speed rotating assembly 40 and its LPT rotor 54. With this arrangement, the driven rotor 30 may rotate at a different (e.g., slower) rotational velocity than the low speed rotating assembly 40 and its LPT rotor 54. However, the drivetrain 60 may alternatively be configured as a direct drive drivetrain, where the geartrain 62 is omitted. With this arrangement, the driven rotor 30 rotates at a common (the same) rotational velocity as the low speed rotating assembly 40 and its LPT rotor 54. Referring again to FIG. 1, each of the rotating assemblies 38, 40 and its members may be rotatable about the axial centerline 36.

During operation of the gas turbine engine 26, air may be directed across the driven rotor 30 (e.g., the propulsor rotor 32) and into the engine core 24 through the core inlet 48. This air entering the core flowpath 46 may be referred to as core air. The core air is compressed by the compressor rotors 52 and directed into a combustion chamber 64 (e.g., an annular combustion chamber) within a combustor 66 (e.g., an annular combustor) of the combustor section 43. Fuel is injected into the combustion chamber 64 by one or more fuel injectors 68 and mixed with the compressed core air to provide a fuel-air mixture. This fuel-air mixture is ignited and combustion products thereof flow through and sequentially cause the HPT rotor 53 and the LPT rotor 54 to rotate. The rotation of the HPT rotor 53 drives rotation of the compressor rotors 52 and, thus, the compression of the air received from the core inlet 48. The rotation of the LPT rotor 54 drives rotation of the driven rotor 30. Where the driven rotor 30 is configured as the propulsor rotor 32, the rotation of that propulsor rotor 32 may propel additional air (e.g., outside air, bypass air, etc.) outside of the engine core 24 to provide aircraft thrust and/or lift. Where the driven rotor 30 is configured as the generator rotor, the rotation of that generator rotor may facilitate generation of electricity.

While the gas turbine engine 26 and its engine core 24 are described above with the two rotating assemblies 38 and 40, the present disclosure is not limited to such an exemplary arrangement. The gas turbine engine 26 and its engine core 24, for example, may alternatively include a single rotating assembly or three or more rotating assemblies. Moreover, while the system 20 is generally described above with respect to aircraft applications, the present disclosure is not limited thereto. The gas turbine engine 26, for example, may alternatively be configured as or otherwise included as part of a ground-based industrial powerplant. However, for ease of description, the system 20 may be described below with respect to the aircraft system of FIG. 1.

Figure 2:
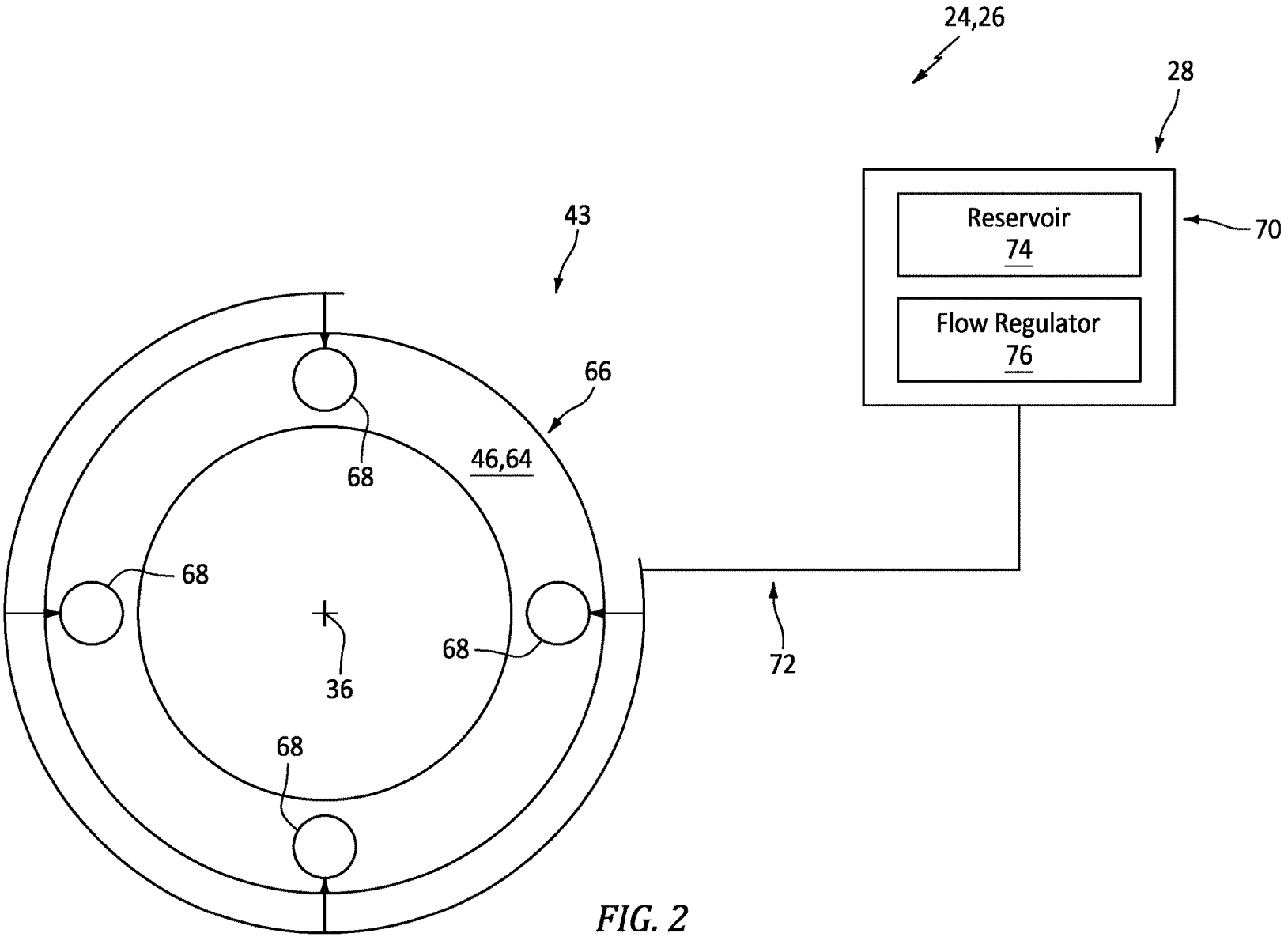
FIG. 2 is a partial schematic illustration of a combustor section of the gas turbine engine with a fuel delivery system.

Referring to FIG. 2, the fuel delivery system 28 is configured to deliver the fuel to the combustor 66 for combustion as described above. The fuel delivery system 28 of FIG. 2, for example, includes a fuel source 70, a fuel supply circuit 72 and the one or more fuel injectors 68.

The fuel source 70 of FIG. 2 includes a fuel reservoir 74 and a fuel flow regulator 76. The fuel reservoir 74 is configured to store a quantity of fuel before, during and/or after aircraft system operation. The fuel reservoir 74, for example, may be configured as or otherwise include a tank, a cylinder, a pressure vessel, a bladder or any other type of fuel storage container. The fuel flow regulator 76 is configured to control a flow of the fuel from the fuel reservoir 74 to one or more downstream components of the fuel delivery system 28. The fuel flow regulator 76 of FIG. 2, for example, is configured to direct a flow of the fuel from the fuel reservoir 74 through the fuel supply circuit 72 to the fuel injectors 68. The fuel flow regulator 76, for example, may be configured as or otherwise include a compressor, a pump and/or a valve (or valves).

Figure 3:
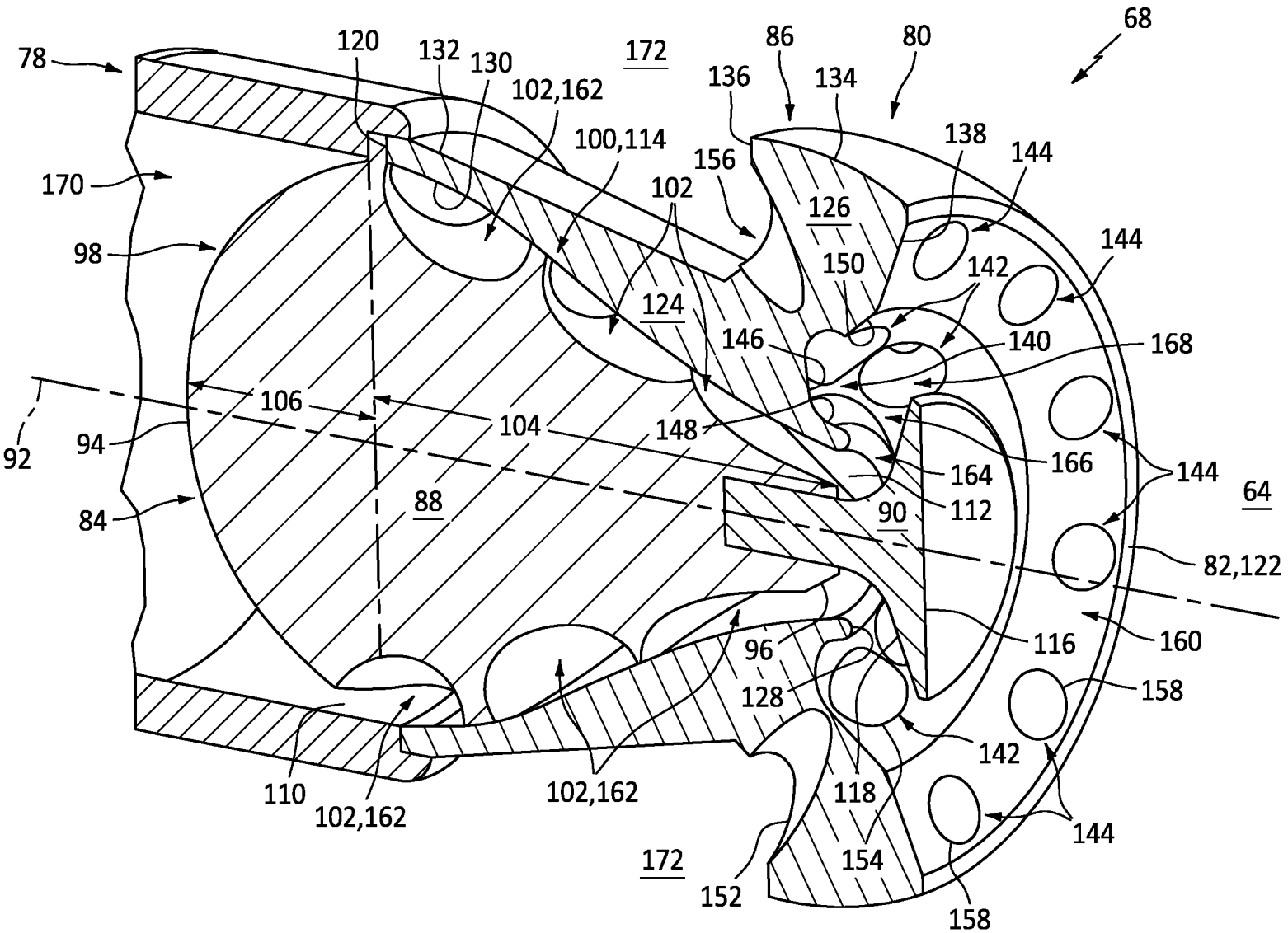
FIG. 3 is a partial perspective sectional illustration of a fuel injector of the gas turbine engine.

The fuel injectors 68 of FIG. 2 are arranged circumferentially about the axial centerline 36 in an annular array. Referring to FIG. 3, each fuel injector 68 includes a fuel injector stem 78 and a fuel injector head 80. The injector head 80 is connected to the injector stem 78, and is located at a distal end 82 (e.g., a tip) of the respective fuel injector 68. The injector head 80 of FIG. 3 includes an injector inner structure 84 (e.g., a fuel nozzle structure) and an injector outer structure 86 (e.g., an air swirler body).

The injector inner structure 84 of FIG. 3 includes a fuel nozzle insert 88 and a fuel nozzle flow guide 90; e.g., a nozzle deflector tip. The nozzle insert 88 extends axially along an axis 92 from an upstream end 94 of the nozzle insert 88 to a downstream end 96 of the nozzle insert 88, where the axis 92 may be a centerline axis of the injector head 80 and its members 84 and 86. The nozzle insert 88 of FIG. 3 includes an upstream section 98, a downstream section 100 and one or more fuel channels 102.

The insert upstream section 98 is disposed at the insert upstream end 94. The insert upstream section 98 of FIG. 3, for example, extends axially along the axis 92 from the insert downstream section 100 to the insert upstream end 94. This insert upstream section 98 may be configured with a bulbous (e.g., rounded, partially spherical, etc.) geometry. An outer periphery of the insert upstream section 98, for example, may have a curved (e.g., partially circular, partially oval, splined, etc.) sectional geometry when viewed, for example, in a reference plane parallel with (e.g., including) the axis 92.

The insert downstream section 100 is disposed at the insert downstream end 96.

The nozzle insert 88 of FIG. 3, for example, extends axially along the axis 92 from the insert upstream section 98 to the insert downstream end 96. The insert downstream section 100 of FIG. 3 is also connected to (e.g., formed integral with or otherwise attached to) the insert upstream section 98. This insert downstream section 100 may be configured with a conical geometry. An outer periphery of the insert downstream section 100, for example, (e.g., continuously or intermittently) radially tapers inwards towards the axis 92 as the insert downstream section 100 extends axially along the axis 92 from (or about) the insert upstream section 98 to (or about) the insert downstream end 96. With such an arrangement, the nozzle insert 88 may have a generally teardrop shape when viewed in the reference plane.

The insert downstream section 100 of FIG. 3 has an axial length 104 along the axis 92 which is greater than an axial length 106 of the insert upstream section 98. The downstream section length 104, for example, may be between (e.g., depending on flow distribution requirements) one and one-half times (1.5$x$) and ten times (10$x$) the upstream section length 106; e.g., between three times (3$x$) and five times (5$x$) the upstream section length 106. The present disclosure, however, is not limited to such an exemplary dimensional relationship.

Figure 4:
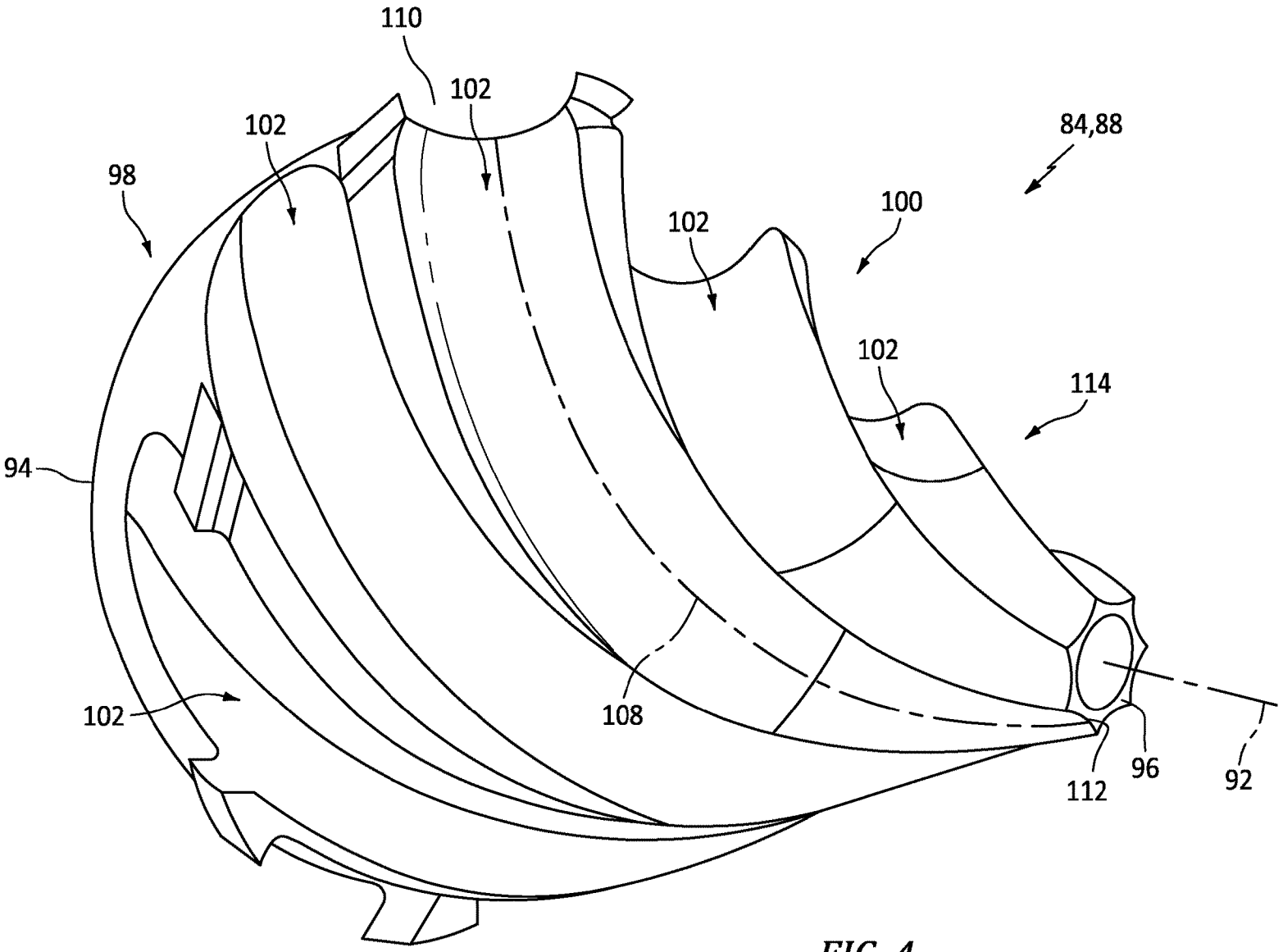
FIG. 4 is a perspective illustration of a fuel nozzle insert of the fuel injector.

Referring to FIG. 4, the fuel channels 102 are arranged circumferentially about the axis 92 in an array. Each of these fuel channels 102 projects (e.g., radially) into the nozzle insert 88 and its insert downstream section 100 from the outer periphery of the insert downstream section 100. Each of the fuel channels 102 extends longitudinally along a longitudinal centerline 108 of the respective fuel channel 102 through the nozzle insert 88 from an upstream end 110 of the respective nozzle channel 102 to a downstream end 112 of the respective nozzle channel 102. The channel upstream end 110 may be formed in the outer periphery of the insert upstream section 98, for example at an intersection between the insert upstream section 98 and the insert downstream section 100. The channel downstream end 112 is formed by the insert downstream section 100 at the insert downstream end 96. The channel downstream end 112 may also be circumferentially offset from the channel upstream end 110 about the axis 92. Each of the fuel channels 102 and its channel centerline 108 of FIG. 4, for example, have a spiraled geometry/a spiraled trajectory. With this arrangement, the fuel channels 102 of FIG. 4 converge radially inwards towards the axis 92 as the fuel channels 102 spiral about the axis 92 from (or about) the intersection towards (e.g., to) the insert downstream end 96. More particularly, the fuel channels 102 may partially form a fuel swirler 114 in the injector inner structure 84; see also FIG. 3.

Referring to FIG. 3, the nozzle flow guide 90 is connected to the nozzle insert 88 at its insert downstream end 96. The nozzle flow guide 90 of FIG. 3, for example, is mechanically attached (e.g., via a threaded connection) to the insert downstream section 100. This nozzle flow guide 90 projects axially along the axis 92 out from the insert downstream end 96 to a downstream end 116 of the injector inner structure 84 and its nozzle flow guide 90. An outer surface 118 of the nozzle flow guide 90 turns radially outwards to (e.g., axially) face the nozzle insert 88. The flow guide outer surface 118 of FIG. 3, for example, has a (e.g., concave) curved sectional geometry, where an upstream portion of the flow guide outer surface 118 substantially extends axially along the axis 92 and a downstream portion of the flow guide outer surface 118 substantially extends radially away from the axis 92. The flow guide outer surface 118 also extends circumferentially about (e.g., completely around) the axis 92 and the nozzle flow guide 90. With this arrangement, the flow guide outer surface 118 may have a curved frustoconical geometry; e.g., a geometry of a frustrum of a concave cone.

The injector outer structure 86 extends axially along the axis 92 from an upstream end 120 of the injector outer structure 86 to a downstream end 122 of the injector outer structure 86, which outer structure downstream end 122 may also be the injector distal end 82. The injector outer structure 86 of FIG. 3 includes a tubular base 124 and an annular flange 126 connected to (e.g., formed integral with or otherwise attached to) the outer structure base 124.

The outer structure base 124 extends axially along the axis 92 from the outer structure upstream end 120 to a downstream end 128 of the outer structure base 124. This base downstream end 128 of FIG. 3 is (e.g., slightly) axially recessed from the outer structure downstream end 122. The outer structure base 124 extends radially from a tubular inner surface 130 of the outer structure base 124 to a tubular outer surface 132 of the outer structure base 124. The base inner surface 130 of FIG. 3 (e.g., continuously or intermittently) radially tapers as the outer structure base 124 extends axially from (or about) the outer structure upstream end 120 to (or about) the base downstream end 128. The base inner surface 130 also extends circumferentially about (e.g., completely around) the axis 92. This base inner surface 130 may have an undulating (e.g., S-shaped) sectional geometry when viewed, for example, in the reference plane. An axial upstream portion of the base inner surface 130 of FIG. 3, for example, is concave. An axial downstream portion of the base inner surface 130 of FIG. 3 is convex, where the axial downstream portion may meet the axial upstream portion at an inflection point.

The outer structure flange 126 projects radially out from the outer structure base 124 and its base outer surface 132 to a distal outer end 134 of the outer structure flange 126. The outer structure flange 126 extends axially between an upstream side 136 of the outer structure flange 126 and a downstream side 138 of the outer structure flange 126, where a corner between the flange downstream side 138 and the flange outer end 134 may be disposed at the outer structure downstream end 122 and/or the injector distal end 82. With this arrangement, the outer structure flange 126 may have a cupped shaped geometry which leans axially towards the outer structure downstream end 122 and/or the injector distal end 82.

Figure 5:
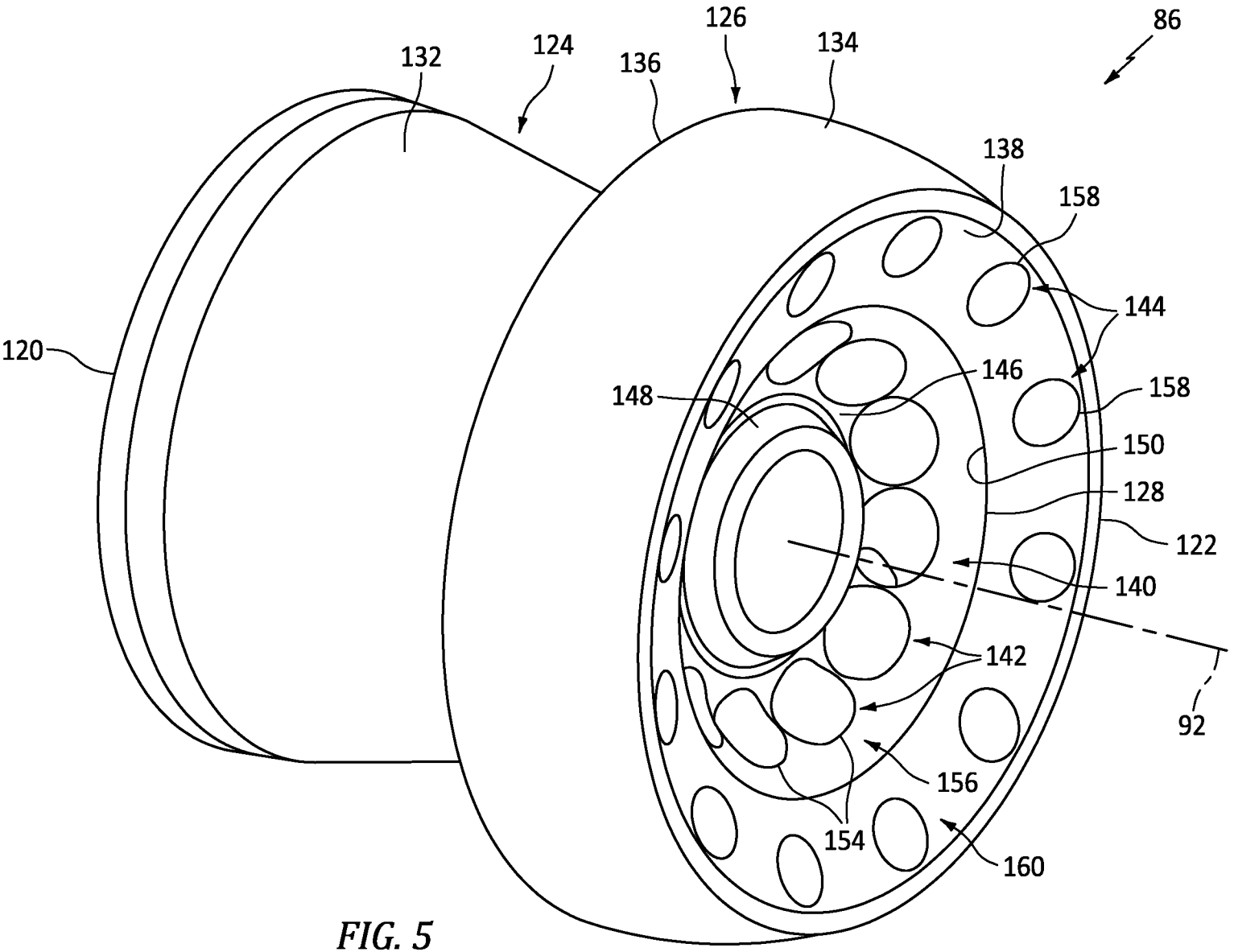
FIG. 5 is a perspective illustration of an air swirler body of the fuel injector.

Referring to FIG. 5, the injector outer structure 86 also includes an annular mixing channel 140 and one or more air passages 142 and 144. The mixing channel 140 extends axially along the axis 92 into the injector outer structure 86 from the flange downstream side 138 to an axial distal end 146 of the mixing channel 140. The mixing channel 140 extends radially within the injector outer structure 86 and its members 124 and 126 between an inner side 148 of the mixing channel 140 and an outer side 150 of the mixing channel 140, where the channel inner side 148 is formed by the outer structure base 124 and the channel outer side 150 is formed by the outer structure flange 126. The mixing channel 140 extends within the injector outer structure 86 and its members 124 and 126 circumferentially about (e.g., completely around) the axis 92.

The air passages 142 and 144 of FIG. 5 are arranged in one or more arrays. The inner air passages 142, for example, are arranged circumferentially about the axis 92 in an inner passage array. The outer air passages 144 are arranged circumferentially about the axis 92 in an outer passage array, where the outer passage array and its outer air passages 144 are disposed radially outboard of the inner passage array and its inner air passages 142.

Referring to FIG. 3, each of the inner air passages 142 extends longitudinally along a longitudinal centerline of the respective inner air passage 142 through the outer structure flange 126 from an inlet 152 into the respective inner air passage 142 to an outlet 154 from the respective inner air passage 142. The inner air passage inlet 152 is disposed in the flange upstream side 136, and the inner air passage outlet 154 is disposed along the mixing channel 140; e.g., at an intersection between the channel distal end 146 and the channel outer side 150; see also FIG. 5. A trajectory of the inner air passage centerline of FIG. 3 includes an axial component and a radial component. The trajectory of the inner air passage centerline may also include a circumferential component. With such an arrangement, the inner air passages 142 may converge radially inwards towards the axis 92 and may spiral about the axis 92 as these inner air passages 142 extend (e.g., longitudinally, axially, etc.) from their inlets 152 to their outlets 154 and the mixing channel 140. More particularly, the inner air passages 142 may form an inner air swirler 156 in the injector outer structure 86. This inner air swirler 156 and the fuel swirler 114 may share a common (the same) swirl direction about the axis 92, or may have opposite swirl directions about the axis 92 to promoting fuel-air mixing.

Each of the outer air passages 144 extends longitudinally along a longitudinal centerline of the respective outer air passage 144 through the outer structure flange 126 from an inlet (not visible) into the respective outer air passage 144 to an outlet 158 from the respective outer air passage 144. The outer air passage inlet is disposed in the flange upstream side 136, and the outer air passage outlet 158 is disposed in the flange downstream side 138 radially outboard of the mixing channel 140. A trajectory of the outer air passage centerline of FIG. 3 includes an axial component and a radial component. The trajectory of the outer air passage centerline may also include a circumferential component. With such an arrangement, the outer air passages 144 may converge radially inwards towards the axis 92 and may spiral about the axis 92 as these outer air passages 144 extend (e.g., longitudinally, axially, etc.) from their inlets to their outlets 158. More particularly, the outer air passages 144 may form an outer air swirler 160 in the injector outer structure 86. This outer air swirler 160, the inner air swirler 156 and the fuel swirler 114 may share a common (the same) swirl direction about the axis 92, or the outer air swirler 160 may have a swirl direction that is opposite from the swirl direction of the inner air swirler 156 and/or the swirl direction of the fuel swirler 114.

The injector inner structure 84 is mated with the injector outer structure 86. The nozzle insert 88 of FIG. 3, for example, is partially inserted axially into (e.g., from a forward end of) an inner bore of the injector outer structure 86 and its outer structure base 124. The nozzle flow guide 90 is partially inserted axially into (e.g., from an aft end of) the inner bore of the injector outer structure 86 and its outer structure base 124, and the nozzle flow guide 90 is attached (e.g., threaded into) the nozzle insert 88. The injector outer structure 86 and its members 124 and 126 extend circumferentially about (e.g., circumscribe) the injector inner structure 84 and its members 88 and 90. The base inner surface 130 circumscribes and is positioned radially next to (e.g., abutted against) the outer periphery of the insert downstream section 100. Each of the fuel channels 102 may thereby form a respective fuel passage 162 radially between the nozzle insert 88 and the outer structure base 124. Like the fuel channels 102, the fuel passages 162 converge radially inwards towards the axis 92 as the fuel passages 162 spiral about the axis 92 from (or about) the intersection towards (e.g., to) an annular guide passage 164.

The guide passage 164 is formed radially between and by the nozzle flow guide 90 and its flow guide outer surface 118 and the injector outer structure 86 and its outer structure base 124. The guide passage 164 is also formed axially between and by the nozzle flow guide 90 and its flow guide outer surface 118 and the injector outer structure 86 and its outer structure base 124, where the flow guide outer surface 118 radially overlaps injector outer structure 86 and its outer structure base 124. The injector inner structure 84 and its nozzle flow guide 90 thereby form an inner peripheral boundary of the guide passage 164. The injector outer structure 86 and its outer structure base 124 form an outer peripheral boundary of the guide passage 164. With this arrangement, the guide passage 164 turns radially outward as the guide passage 164 extends away from the fuel passages 162 towards (e.g., to) an annular mixing cavity 166.

The mixing cavity 166 includes the mixing channel 140 and an annular volume axially between the mixing channel 140 and the nozzle flow guide 90 and its flow guide outer surface 118. The mixing cavity 166, more particularly, is formed by and axially between the injector outer structure 86 and its members 124 and 126 and the nozzle flow guide 90 and its flow guide outer surface 118, where the flow guide outer surface 118 forms a side peripheral boundary of the mixing cavity 166. The mixing cavity 166 is also formed radially within the injector outer structure 86 between the channel inner side 148 and the channel outer side 150. With this arrangement, the mixing cavity 166 fluidly couples the guide passage 164 and each of the inner air passages 142 to an annular fuel injector outlet 168. This injector outlet 168 is disposed at the injector distal end 82, and is formed by and extends radially between an outer distal end of the nozzle flow guide 90 and an outer corner between the channel outer side 150 and the flange downstream side 138.

During operation of the fuel injector 68 of FIG. 3, a fuel supply passage 170 within the injector stem 78 delivers the fuel received from the fuel supply circuit 72 (see FIG. 2) to the injector head 80 and its fuel passages 162. These fuel passages 162 swirl and direct the swirled fuel into the guide passage 164. The swirled fuel engages (e.g., impinges against, flows along, etc.) the flow guide outer surface 118, where the nozzle flow guide 90 and its flow guide outer surface 118 turns a trajectory of the swirled fuel from a substantially axial direction along the axis 92 to a substantially radial direction away from the axis 92. The nozzle flow guide 90 and its flow guide outer surface 118 thereby direct the swirled fuel received from the fuel passages 162 radially outward (e.g., and slightly axially) into the mixing cavity 166. At the same time, the inner air passages 142 receive the compressed core air from a plenum 172 surrounding the combustor 66; see also FIG. 1. These inner air passages 142 swirl and direct the compressed core air into the mixing cavity 166 as inner swirled air, and the swirled fuel and the inner swirled air at least partially (or completely) mix to provide an inner fuel-air mixture. This inner fuel-air mixture is subsequently directed out of the fuel injector 68 through the fuel injector outlet 168 and into the combustion chamber 64. At the same time, the outer air passages 144 also receive the compressed core air from the plenum 172 surrounding the combustor 66. These outer air passages 144 swirl and direct the compressed core air into the combustion chamber 64 (e.g., bypassing the mixing cavity 166) as outer swirled air, and the outer swirled air mixes with the inner fuel-air mixture to provide the (e.g., final) fuel-air mixture for combustion within the combustion chamber 64. Of course, it is contemplated the fuel-air mixture may be further modified by additional air from apertures (e.g., primary air apertures, dilution apertures, quench apertures, etc.) in walls of the combustor 66, etc. to tune combustion dynamics.

The fuel received by the fuel passages 162 and injected into the combustion chamber 64 through the injector head 80 may be a gaseous fuel (e.g., fuel in a gaseous phase) such as gaseous hydrogen ($H_2$) fuel; e.g., hydrogen ($H_2$) gas. With such a gaseous fuel, swirling the fuel and the air entering the mixing cavity 166 may facilitate improved emissions control, ignition and/or flame stability within the combustion chamber 64. However, mixing fuel and air within the mixing cavity 166 may also provide benefits for other gaseous fuels, including hydrocarbon fuels such as nature gas, propane and the like. Moreover, it is further contemplated the injector head 80 of the present disclosure may also provide improved combustion for various liquid fuels; e.g., a fuel in a liquid phase.

In some embodiments, referring to FIG. 3, the injector inner structure 84 may be configured as a multi-component structure where the nozzle insert 88 and the nozzle flow guide 90 are discretely formed and subsequently attached together. The injector outer structure 86, on the other hand, may be configured as a single monolithic body. The present disclosure, however, is not limited to such an exemplary arrangement. In other embodiments, for example, the entire injector head 80 may be formed (e.g., additively manufactured) together as a single monolithic body or otherwise.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A fuel delivery apparatus for a gas turbine engine, comprising:

a fuel nozzle insert;

a flow guide connected to and projecting axially along an axis out from an end of the fluid nozzle insert;

an air swirler body circumscribing the fuel nozzle insert and the flow guide;

a plurality of fuel passages formed by and radially between the fuel nozzle insert and the air swirler body, the plurality of fuel passages radially converging and spiraling about the fuel nozzle insert towards the flow guide;

an annular mixing cavity formed by and axially between the flow guide and the air swirler body;

an annular guide passage extending radially outward from the plurality of fuel passages to the annular mixing cavity; and a plurality of air passages projecting axially through the air swirler body to the mixing cavity.

2. The fuel delivery apparatus of claim 1, wherein the plurality of air passages are a plurality of inner air passages, and the air swirler body further includes a plurality of outer air passages arranged in an array radially outboard of the plurality of inner air passages; and each of the plurality of outer air passages extends through the air swirler body.

3. A fuel delivery apparatus for a gas turbine engine, comprising:

a fuel injector including a plurality of fuel passages, a guide passage, a plurality of air passages, a mixing cavity and a fuel injector outlet;

the plurality of fuel passages extending along an axis to the guide passage, and the plurality of fuel passages converging radially inwards towards the axis as the plurality of fuel passages spiral about the axis towards the guide passage;

the guide passage turning radially outwards away from the axis as the guide passage extends from the plurality of fuel passages to the mixing cavity;

the plurality of air passages converging radially inwards towards the axis as the plurality of air passages extend axially to the mixing cavity;

the mixing cavity fluidly coupling the guide passage and the plurality of air passages to the fuel injector outlet;

the fuel injector further including an inner structure and an outer structure circumscribing the inner structure;

each of the plurality of fuel passages disposed radially between and formed by the inner structure and the outer structure; and the mixing cavity disposed axially between and formed by the inner structure and the outer structure.

4. The fuel delivery apparatus of claim 3, wherein at least one of:

the guide passage is an annular guide passage;

the mixing cavity is an annular mixing cavity; or the fuel injector outlet is an annular fuel injector outlet.

5. The fuel delivery apparatus of claim 3, wherein the guide passage is disposed radially and axially between and formed by the inner structure and the outer structure.

6. The fuel delivery apparatus of claim 3, wherein the inner structure comprises an insert disposed in an inner bore of the outer structure; and each of the plurality of fuel passages comprises a channel projecting into the insert.

7. The fuel delivery apparatus of claim 3, wherein each of the plurality of air passages extends through a flange of the outer structure.

8. The fuel delivery apparatus of claim 7, wherein the plurality of air passages are a plurality of inner air passages, and the fuel injector further includes a plurality of outer air passages arranged radially outboard of the plurality of inner air passages; and each of the plurality of outer air passages extends through the flange of the outer structure.

9. The fuel delivery apparatus of claim 3, wherein the plurality of air passages further extends circumferentially about the axis as the plurality of air passages extend axially to the mixing cavity.

10. The fuel delivery apparatus of claim 3, further comprising a fuel source configured to deliver gaseous fuel to the fuel injector.

11. A fuel delivery apparatus for a gas turbine engine, comprising:

a fuel injector including a plurality of fuel passages, a guide passage, a plurality of air passages, a mixing cavity and a fuel injector outlet;

the plurality of fuel passages extending along an axis to the guide passage, and the plurality of fuel passages converging radially inwards towards the axis as the plurality of fuel passages spiral about the axis towards the guide passage;

the guide passage turning radially outwards away from the axis as the guide passage extends from the plurality of fuel passages to the mixing cavity;

the plurality of air passages converging radially inwards towards the axis as the plurality of air passages extend axially to the mixing cavity;

the mixing cavity fluidly coupling the guide passage and the plurality of air passages to the fuel injector outlet;

the fuel injector further including an inner structure and an outer structure circumscribing the inner structure;

each of the plurality of fuel passages disposed radially between and formed by the inner structure and the outer structure;

the inner structure comprising an insert disposed in an inner bore of the outer structure;

each of the plurality of fuel passages comprising a channel projecting into the insert;

the inner structure further comprising a flow guide attached to and projecting axially out from an end of the insert;

the flow guide comprising an outer surface forming an inner peripheral boundary of the guide passage; and the outer surface having a curved sectional geometry which curves radially outward away from the axis as the outer surface extends axially away from the insert.

12. The fuel delivery apparatus of claim 11, wherein the outer surface radially overlaps the outer structure and further forms a side peripheral boundary of the mixing cavity.

13. The fuel delivery apparatus of claim 11, wherein the fuel injector outlet extends between and is formed by an outer peripheral edge of the flow guide and the outer structure.

14. The fuel delivery apparatus of claim 11, wherein the flow guide is attached to the insert by a threaded connection.

* * * * *